US007159638B2

(12) United States Patent
Hsu

(10) Patent No.: US 7,159,638 B2
(45) Date of Patent: Jan. 9, 2007

(54) PULL CORD CONTROL DEVICE FOR VENETIAN BLIND

(75) Inventor: Ben Hsu, Changhua Hsien (TW)
(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 198 days.

(21) Appl. No.: 10/883,763

(22) Filed: Jul. 6, 2004

(65) Prior Publication Data

US 2005/0224192 A1 Oct. 13, 2005

(30) Foreign Application Priority Data

Apr. 12, 2004 (TW) ..... 93205551 U

(51) Int. Cl.
*E06B 9/324* (2006.01)

(52) U.S. Cl. ..... 160/178.2; 24/115 L

(58) Field of Classification Search ..... 160/178.2, 160/168.1 R, 173 R; 24/136 A, 115 L
See application file for complete search history.

(56) References Cited

U.S. PATENT DOCUMENTS

| | | | | |
|---|---|---|---|---|
| 4,245,688 | A * | 1/1981 | Vecchiarelli | 160/178.2 |
| 4,531,563 | A * | 7/1985 | Nilsson | 160/168.1 R |
| 4,667,723 | A * | 5/1987 | Spangenberg | 160/178.2 |
| 5,263,528 | A * | 11/1993 | Patel | 160/178.2 |
| 2003/0201076 | A1* | 10/2003 | Nien | 160/168.1 R |

* cited by examiner

*Primary Examiner*—Blair M. Johnson
(74) *Attorney, Agent, or Firm*—Troxell Law Office, PLLC

(57) ABSTRACT

A pull cord control device for Venetian blind includes a mounting body made up of an engagement piece having symmetrical registration posts for positioning rollers to be mounted thereto, and a limiting piece equipped with a pair of teeth racks symmetrically extending at both sides thereon in mesh with a control gear disposed at one side thereof to define a confinement space there-between for a coupling post with an embossed mounted thereto to be located in the middle thereof. A U-shaped groove is vertically indented at the inner side of the limiting piece therein for a U-shaped and metallic protection rod to be located therein and abutted against the upper edge of the confinement space thereof A decoration lid of an oval shape with a pull-cord passage slot disposed thereon is integrally formed at one end of the limiting piece thereof with the protection rod exposed precisely at the inner lower edge of the pull-cord passage slot thereof. A cover having coupling holes to be registered with the limiting body thereof is provided with a plane abutting facet to be precisely abutted against the inner upper edge of the decoration lid thereby. Thus, a pull cord guided through the upper edge of the protection rod before suspended downwards through the pull-cord passage slot of the decoration lid is refrained from directly rubbing against the frame edges of the pull-cord passage slot when drawn to any sides therein to fold/unfold the Venetian blind thereof, facilitating a smooth operation of the pull cord to achieve the best using condition thereof.

3 Claims, 4 Drawing Sheets

PULL CORD CONTROL DEVICE FOR VENETIAN BLIND

BACKGROUND OF THE INVENTION

The present invention is related to a pull cord control device for Venetian blind, including a mounting body made up of an engagement piece extending at one side thereof, and a limiting piece disposed at the other side thereof wherein a U-shaped groove is vertically indented at the inner side of the limiting piece therein for a U-shaped and metallic protection rod to be located therein and abutted against the upper edge of a confinement space defined by a pair of teeth racks symmetrically extending at the limiting piece thereon. A decoration lid of an oval shape with a pull-cord passage slot disposed thereon is integrally formed at one end of the limiting piece thereof with the protection rod exposed precisely at the inner lower edge of the pull-cord passage slot thereof, whereby, a pull cord guided through the upper edge of the protection rod before suspended downwards through the pull-cord passage slot of the decoration lid is refrained from directly rubbing against the frame edges of the pull cord passage slot when drawn to any sides therein to fold/unfold the Venetian blind thereof, and facilitating a smooth operation of the pull cord to achieve the best using condition thereof Please refer to FIGS. 1 to 2 inclusive. A conventional pull cord control device for Venetian blind includes a mounting body 10 having a pair of positioning stop blocks of half-oval shape 11 symmetrically extending at both sides thereof. A triangular wing 111 is protruding at the outer side of each positioning stop block 11 thereof, and a U-shaped engaging groove 112 is indented at the inner side of the positioning stop blocks 11 thereof for retaining a division rod 20 therein. The mounting body 10 is also equipped with a limiting piece 12 having a pair of teeth racks 121 symmetrically tilted thereon in mesh with a control gear 122 disposed at one side thereof to define a confinement space 14 there-between for a coupling post 13 with an embossed roller 131 mounted thereto to be located in the middle thereof At the other side of the mounting body 10 thereof is disposed an engagement piece 15 having a pair of symmetrical registration posts 151 properly protruding thereon for positioning rollers 152 to be engaged therewith respectively, and a pair of abutting blocks 153 extending downwards at one side thereof A cover 30 having a plurality of coupling holes 31 distributed thereon to be registered with the coupling post 13 and the registration posts 151 of the mounting body 10 respectively is provided with a lid 32 of an oval shape extending at one end thereon to be abutted against the positioning stop blocks 11 of the mounting body 10 thereby. A pull-cord passage slot 321 is disposed at the center of the lid 32 thereof, and a pair of resilient hooks 33 is symmetrically tilted outwards at both outer lateral edges of the cover 30 thereof. In assembly, both ends of a pull cord 40' extended by one of the positioning roller 152 and led through the space defined by the embossed roller 131 and the control gear 122 thereof are individually passed through the upper and lower sides of the division rod 20 separately before suspending downwards through the pull-cord passage slot 311 thereof The engagement piece 15 of the mounting body 10 is then led through a locating through hole 41 of an upper beam 40 till the resilient hooks 33 and the triangular wings 111 thereof are respectively stopped at both inner lateral sides of the locating through hole 41 thereof. Meanwhile, the abutting blocks 153 of the engagement piece 15 thereof are retained in place by a stop facet 42 extending at one side of the upper beam 40 thereof to locate the pull cord control device thereof at the upper beam 40 therein for the operation of the pull cord 40' thereof.

There are some drawbacks to such conventional pull cord control device for Venetian blinds. First, both ends of the pull cord 40' are separately led through the upper and lower sides of the division rod 20 respectively before suspending downwards through the pull-cord passage slot 321 as shown in FIG. 3. In case the pull cord 40' is randomly drawn to any sides at the pull cord passage slot 321 therein to fold or unfold the Venetian blind thereof, the pull cord 40' tends to rub directly against the frame edges of the pull cord passage slot 321 thereof in the operation thereof. Under frequent friction thereof, the pull-cord passage slot 321 is easily worn off with rugged frame edges produced thereby, which can inconveniently jam and block the pull cord 40' in operation thereof. Second, when the cover 30 is assembled onto the mounting body 10 thereof, the lid 32 of the cover 30 is abutted against the outer surface of the positioning stop blocks 11 thereof, which inevitably increases the distance between the resilient hooks 33 and the lid 32 thereof. Thus, the control device thereof mounted to the locating through hole 41 of the upper beam 40 is evidently protruded outside the upper beam 40 in assembly, destroying the overall beauty of the upper beam 40 in appearance.

SUMMARY OF THE PRESENT INVENTION

It is, therefore, the primary purpose of the present invention to provide a pull cord control device for Venetian blinds wherein both ends of a pull cord are guided through the upper edge of a U-shaped and metallic protection rod before suspended downwards through a pull-cord passage slot of a decoration lid respectively, precisely refraining the pull cord from directly rubbing against the frame edges of the pull-cord passage slot to avoid the friction generate thereby when drawn to any sides at the pull-cord passage slot therein to fold/unfold the Venetian blind thereof, and facilitating a smooth operation of the pull cord to achieve the best using condition thereof.

It is, therefore, the second purpose of the present invention to provide a pull cord control device for Venetian blinds wherein the decoration lid of an oval shape with the pull-cord passage slot disposed thereon is integrally formed at one end of a limiting piece thereof so that the inner surface of the decoration lid is precisely abutted against a locating through hole of an upper beam to maintain a plane and beautiful appearance of the upper beam as a whole.

DETAILED DESCRIPTION OF THE PREFERRED EMBODIMENTS

Figure 1:
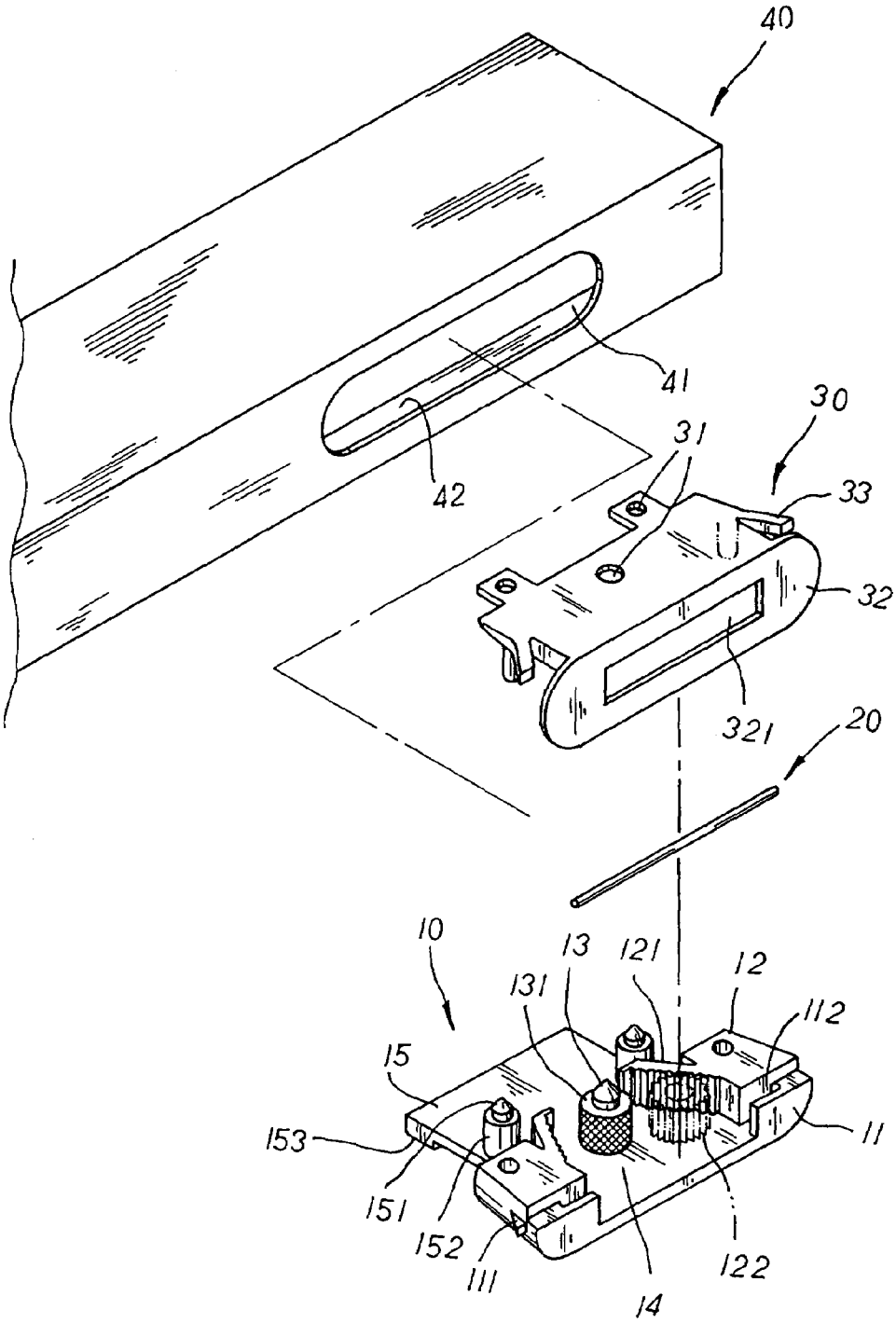
FIG. 1 PRIOR ART
FIG. 1 is a perspective exploded view of a conventional pull cord control device for Venetian blind.
Figure 2:
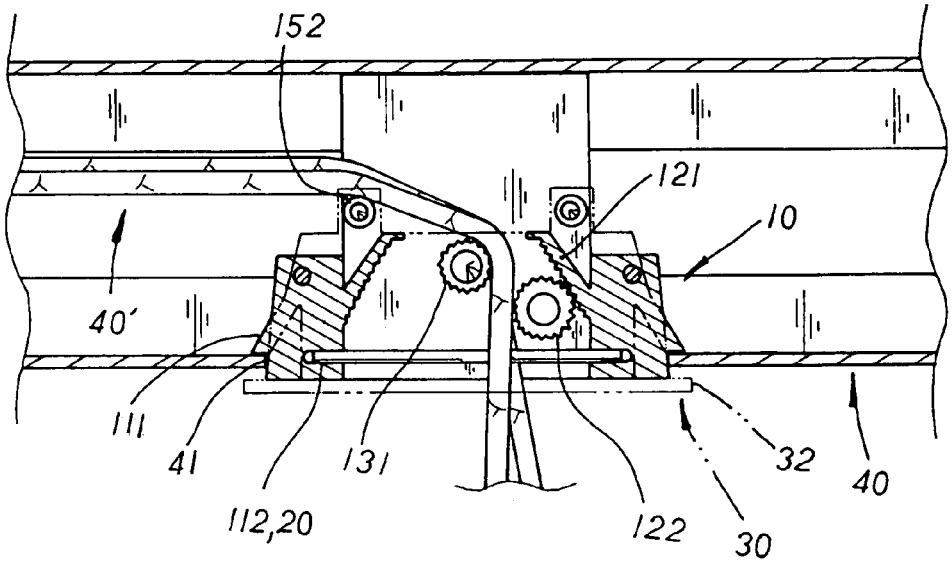
FIG. 2 PRIOR ART
FIG. 2 is a cross sectional view of the conventional pull cord control device for Venetian blind in assembly.
Figure 5:
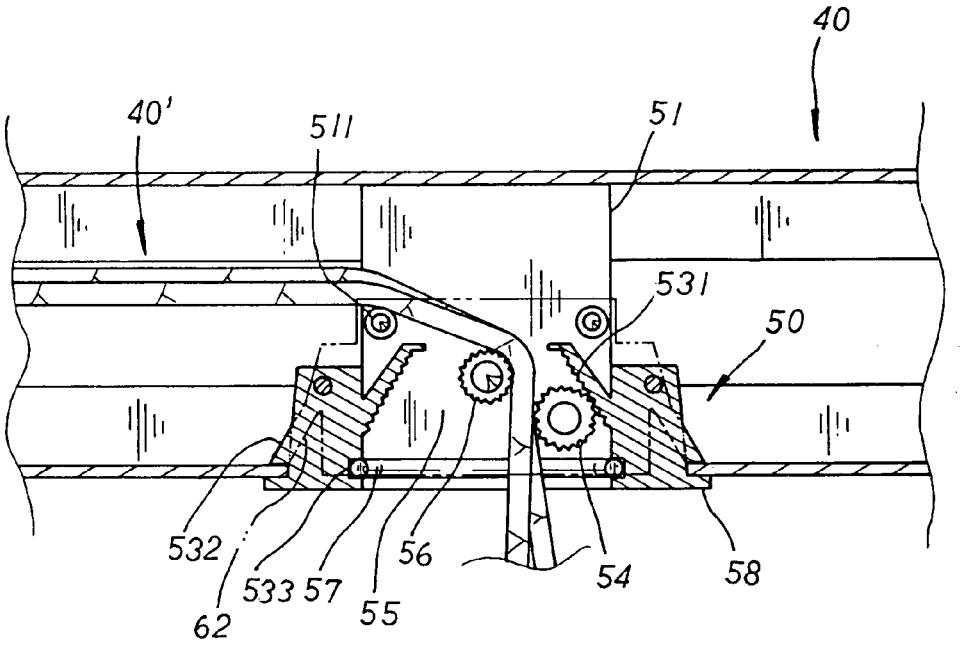
FIG. 5 is a cross sectional view of the present invention in assembly.
Figure 3:
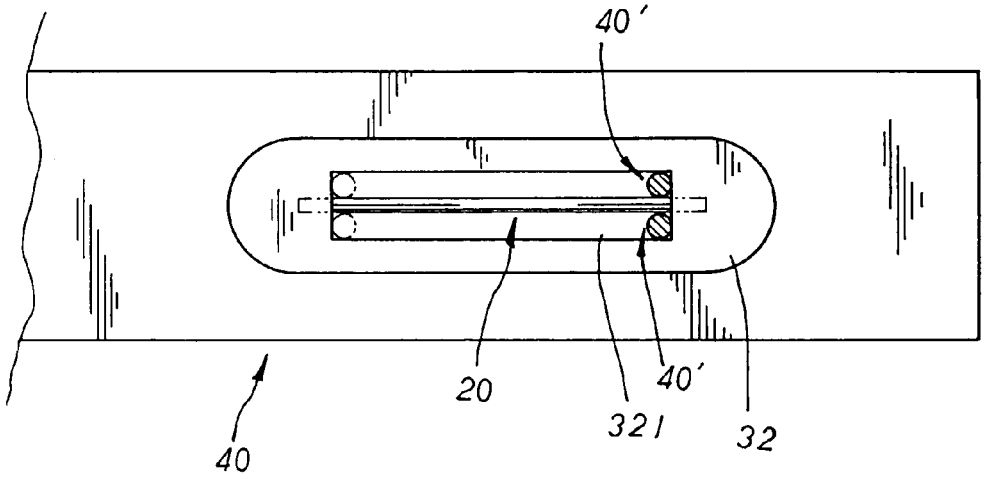
FIG. 3 PRIOR ART
FIG. 3 is a diagram showing a pull cord of the conventional pull cord control device for Venetian blind drawn sideways in operation.
Figure 6:
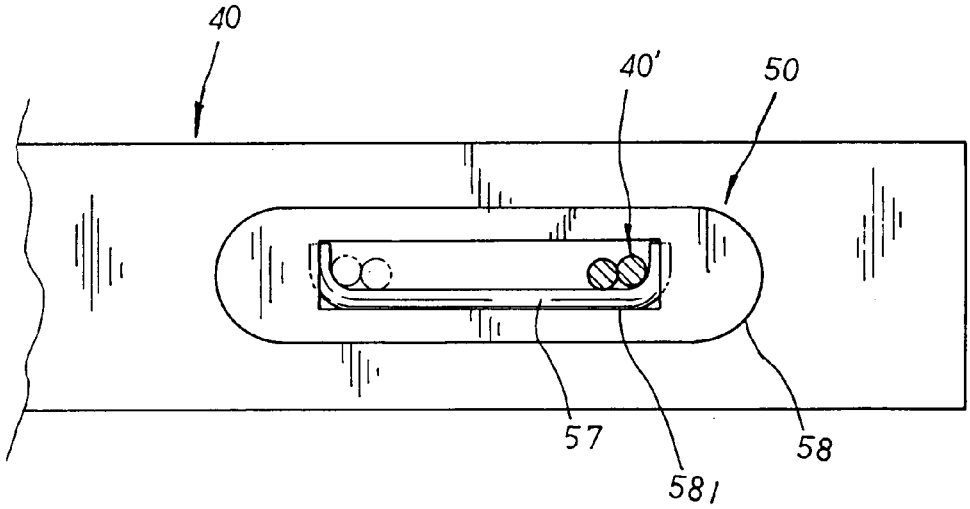
FIG. 6 is a diagram showing a pull cord of the present invention drawn sideways in operation thereof
Figure 4:
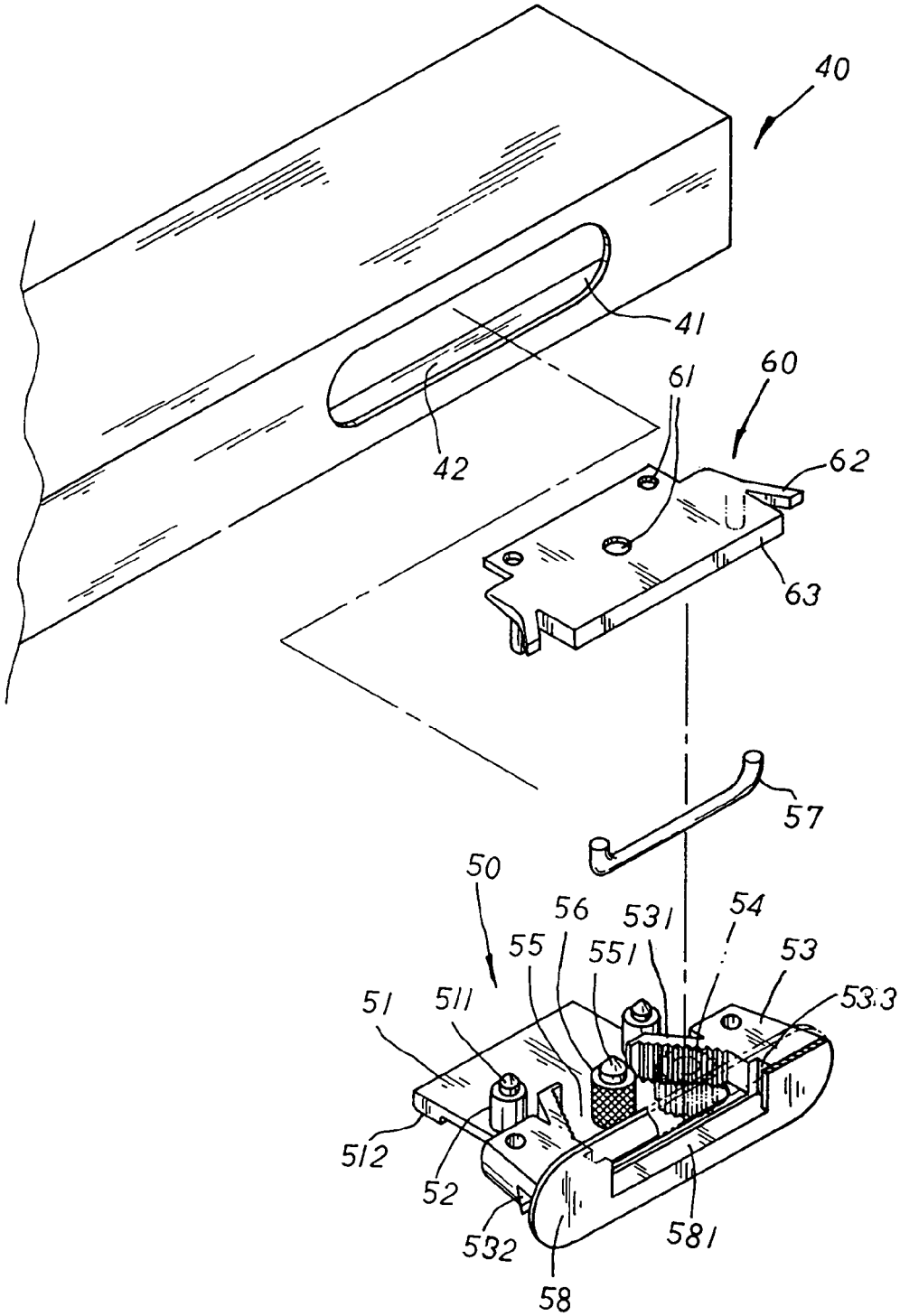
FIG. 4 is a perspective exploded view of the present invention.

Please refer to FIG. 4. The present invention is related to a pull cord control device for Venetian blind, including a mounting body 50 made up of an engagement piece 51 extending at one side thereof, and a limiting piece 53 disposed at the other side thereof The engagement piece 51 thereof has a pair of symmetrical registration posts 511 properly protruding thereon for positioning rollers to be mounted thereto respectively, and a pair of abutting blocks 512 symmetrically extending downwards at one side thereof The limiting piece 53 is equipped with a pair of teeth racks 531 symmetrically extending at both sides thereon in mesh with a control gear 54 disposed at one side thereof, a confinement space 55 defined between the teeth racks 531 thereof, and a coupling post 551 protruding in the middle of the confinement space thereon for an embossed roller 56 to be mounted thereto. A pair of triangular wing blocks 532 is symmetrically protruding at both lateral outer sides of the limiting piece 53 thereof, and a U-shaped groove 533 is vertically defined at the corresponding inner side of the limiting piece 53 therein for a metallic and smooth-surfaced U-shaped protection rod 57 to be located therein and abutted against the upper edge of the confinement space 55 thereof A decoration lid 58 of an oval shape with a pull-cord passage slot 581 disposed thereon is integrally formed at one end of the limiting piece 53 thereof with the protection rod 57 exposed precisely at the inner lower edge of the pull-cord passage slot 581 thereof. A cover 60 having a plurality of coupling holes 61 distributed thereon to be engaged with the registration posts 511 and the coupling post 551 of the mounting piece 50 respectively thereby is provided with two resilient locating hooks 62 symmetrically tilted outwards at both lateral outer edges thereof, and a plane abutting facet 63 defined at one end thereon to be precisely abutted against the inner upper edge of the decoration lid 58 thereof. In assembly, both ends of a pull cord 40' extended by one of the positioning rollers 52 mounted to the registration posts 511 of the engagement section 51 thereof and led through the space defined by the embossed roller 56 and the control gear 54 thereof are guided through the upper edge of the protection rod 57 thereof before suspending downwards through the pull-cord passage slot 581 of the decoration lid 58 respectively. The engagement piece 51 of the mounting body 50 is then led through a locating through hole 41 of an upper beam 41 till the resilient locating hooks 62 and the triangular wing blocks 532 are stopped at the inner side of the locating through hole 41 thereof in abutting location thereby. Meanwhile, the abutting blocks 512 are retained in place by a stop facet 42 extending at one inner side of the upper beam 40 to locate the pull cord control device of the present invention at the upper beam 40 therein for the operation of the pull cord 40' thereof Please refer to FIGS. 5 to 6 inclusive. In practical use, the abutting facet 63 of the cover 60 is closely abutted against the inner upper edge of the decoration lid 58 integrally disposed at one end of the limiting piece 53 thereof, permitting the inner surface of the decoration lid 58 to precisely abut against the locating through hole 41 of the upper beam 40 so as to maintain a plane and beautiful appearance of the upper beam 40 as a whole as shown in FIG. 5. Besides, when the pull cord 40' is drawn to any sides at the pull-cord passage slot 581 therein to fold or unfold the Venetian blind thereof, the protection rod 57 positioned relative to the pull-cord passage slot 581 and located under the pull cord 40' thereof can precisely refrain the pull cord 40' from directly rubbing against the frame edges of the pull-cord passage slot 581 so as to avoid the friction generated thereby, facilitating a smooth operation of the pull cord 40' to achieve the best using condition thereof.

What is claimed is:

1. A pull cord control device for Venetian blind, including a mounting body made up of an engagement piece extending at one side thereof, and a limiting piece disposed at the other side thereof wherein the engagement piece thereof has a pair of symmetrical registration posts properly protruding thereon each of the pair of symmetrical registration posts having rollers mounted thereto respectively and a pair of abutting blocks symmetrically extending downwards at one side thereof, and the limiting piece is equipped with a pair of teeth racks symmetrically extending at both sides thereon in mesh with control gear disposed at one side thereof to define a confinement space there-between for a coupling post with an embossed roller mounted thereto located in the middle thereof; a cover having a plurality of coupling holes distributed thereon to engage with the registration posts and the coupling post of the mounting piece respectively thereby is provided with two resilient locating hooks symmetrically tilted outwards at both outer lateral edges thereof; the pull cord control device further comprising:

a U-shaped groove being vertically indented at the corresponding inner side of the limiting piece therein and a U-shaped protection rod located therein and abutted against the upper edge of the confinement space thereof the U-shaped protection rod having two unturned ends configured to partially engage the U-shaped groove;

a decoration lid of an oval shape with a pull-cord passage slot disposed thereon being integrally formed at one end of the limiting piece thereof with the protection rod exposed precisely at the inner lower edge of the pull-cord passage slot thereof;

a plane abutting facet being defined at one end of the cover thereon precisely abutted against the inner upper edge of the decoration lid thereof;

wherein both ends of a pull cord extending by one of the positioning rollers and led through the space defined by the embossed roller and the control gear thereof are guided through the upper edge of the protection rod before being suspended downwards through the pull-cord passage slot of the decoration lid respectively, to substantially prevent the pull cord from directly rubbing against the frame edges of the pull-cord passage slot.

2. The pull cord control device for Venetian blind as claimed in claim 1 wherein the protection rod is made of metal with a smooth surface defined thereon.

3. The pull cord control device for Venetian blind as claimed in claim 1 wherein each of the two upturned ends of the protection rod has a diameter larger than the depth of the U-shaped groove.

* * * * *